US006547176B1

(12) United States Patent
Blain et al.

(10) Patent No.: US 6,547,176 B1
(45) Date of Patent: Apr. 15, 2003

(54) WIRE UNWINDING CONTROLLER

(75) Inventors: Denis Blain, Repentigny (CA); Edward L. Cooper, Clarklake, MI (US); Martin Paquet, Terrebonne (CA); Viwek Vaidya, Pointe Claire (CA)

(73) Assignee: Air Liquide Canada Inc., Montreal (CA)

( * ) Notice: Subject to any disclaimer, the term of this patent is extended or adjusted under 35 U.S.C. 154(b) by 0 days.

(21) Appl. No.: 10/160,019

(22) Filed: Jun. 4, 2002

(51) Int. Cl.[7] ..... B65H 59/02
(52) U.S. Cl. ..... 242/423.1; 242/128; 242/156.1
(58) Field of Search ..... 242/156, 156.1, 242/156.2, 423.1, 566, 593, 128, 125.3, 172, 419, 157 R

(56) References Cited

U.S. PATENT DOCUMENTS 2,838,922 A * 6/1958 Gift ..... 242/128
2,864,565 A 12/1958 Whearley
4,222,535 A * 9/1980 Hosbein ..... 242/128
4,869,367 A 9/1989 Kawasaki et al.
5,261,625 A * 11/1993 Lanoue ..... 242/156
5,277,314 A * 1/1994 Cooper et al. ..... 242/128
5,494,160 A 2/1996 Gelmetti
5,845,862 A 12/1998 Cipriani

* cited by examiner

*Primary Examiner*—William A. Rivera

(57) ABSTRACT

A controller for controlling the dispensing of wire from a reel of wire positioned within a container. The wire is dispensed from one end of the reel with the other end of the reel sitting on the bottom of the container. The controller has a main body member in the shape of a flat ring sized to rest within the container on the one end of the reel, the ring having concentric, circular, inner and outer edges. Flexible, wire guide flaps are on the inner edge of the ring, the guide flaps extending radially inwardly. Each guide flap has the general shape of a shallow triangle with the apex of the triangle farthest from the ring and the base of the triangle adjacent and integral with the ring.

20 Claims, 2 Drawing Sheets

WIRE UNWINDING CONTROLLER

BACKGROUND OF THE INVENTION

1. Field of the Invention

This invention is directed toward a controller for controlling the unwinding of wire from a reel in a container. The invention is particularly directed toward a controller for controlling the unwinding of welding wire being fed to a robotic welder.

2. Description of the Related Art

Passive controllers are used to prevent the coils of wire on the reel from becoming tangled with each other as the wire is being unwound off the reel and fed to a robotic welding machine. If a controller were not used, the top wire coils, because of the manner in which they are wound to form the reel, could spring up when unwinding and become snarled or tangled with each other causing stoppages in the feeding of the wire. Any downtime to clear the snarls/tangles is costly.

The known controllers usually take the form of a flat ring which rests on the top of the end of the coil from where the wire is being fed, the ring moving down slowly, by gravity, as the wire feeds and the height of the reel diminishes. The presence of the ring on the end of the reel prevents the top coils from springing up and becoming tangled with each other. The ring usually has tabs extending radially outwardly for keeping it centered within the container holding the reel. Examples of ring shaped controllers are shown in U.S. Pat. Nos. 4,869,367 and 5,845,862.

There are problems however associated with the known rings. Rings of the type shown in U.S. Pat. No. 4,869,367, with a smooth, circular inner edge, do not prevent the wire being fed from pulling out one or more additional coils from under the ring which coils can become tangled above the ring. Rings of the type shown in U.S. Pat. No. 5,845,862 use fingers extending radially inwardly from the inner edge of the ring to make it more difficult for wire loops to escape from under the inner edge of the ring during wire feeding. However, when these rings are used with containers having a central core, the fingers abut the core and create additional friction which can slow the ring from dropping down as the height of the reel diminishes during unwinding. If the ring separates from the top end of the reel, there is room for the top wires to be pulled out and become tangled. The ring can be made heavier to minimize the effects of friction from the inner fingers but this adds to the cost of the rings. Further, the known rings, with inwardly extending radial fingers, do not feed the wire as smoothly from the reel since the wire must ride inwardly up each finger with tension increasing and then drop down back to the inner edge of the ring with little or no tension when it clears the end of the finger.

SUMMARY OF THE INVENTION

It is the purpose of the present invention to provide a controller that minimizes the escape of wire coils from under it, particularly inwardly from under it, during wire feeding. It is another purpose of the present invention to minimize the escape of the wire coils while minimizing friction on the controller during operation. It is a further purpose of the present invention to more smoothly feed the wire off the coil to minimize tangling. It is another purpose of the invention to provide a relatively simple, inexpensive and easily manufactured controller.

In accordance with the present invention the controller is in the form of a flat ring having flexible flaps extending inwardly from the inner edge of the ring. The inwardly directed flaps are sized to make it more difficult for the upper coils of wire to escape inwardly from the ring and yet to prevent the flaps from contacting an inner core if one is employed with the container. The flaps are also shaped and formed to guide the wire off the reel relatively smoothly and without tangling. The flaps are shaped to have a wire guiding edge that curves gently inwardly to a release point on the flap. The flap is also formed to have the release point be the highest point on the flap, the flap preferably curved upwardly to the release point. As the wire is moved gradually inwardly and upwardly over each flap, the flap, being flexible, moves upwardly as well before releasing the wire to the next adjacent flap. Thus the wire is guided more smoothly from each flap to the next.

The invention is particularly directed toward a controller for controlling the dispensing of wire from a reel of wire positioned within a container, the wire dispensed from one end of the reel with the other end of the reel sitting on the bottom of the container. The controller has a main body member in the shape of a flat ring sized to rest within the container on the one end of the reel. The ring has concentric, circular, inner and outer edges. The controller includes flexible, wire guide flaps on the inner edge of the ring, the guide flaps extending radially inwardly. Each guide flap has the general shape of a shallow triangle with the apex of the triangle farthest from the ring and the base of the triangle adjacent the ring.

BRIEF DESCRIPTION OF THE DRAWINGS

The invention will now be described having reference to the accompanying drawings in which.

DESCRIPTION OF THE PREFERRED EMBODIMENTS

Figure 1:
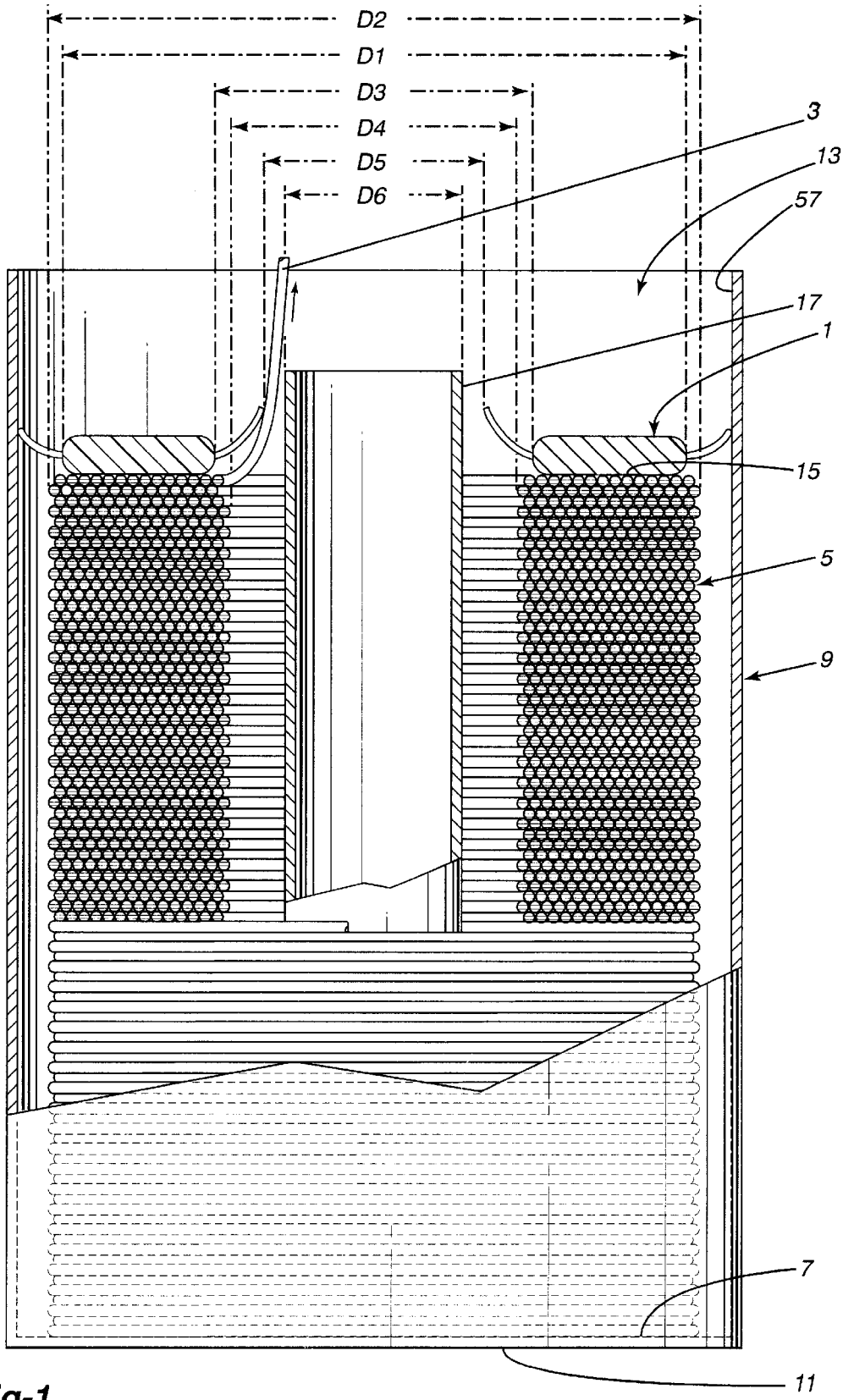
FIG. 1 is a cross-section view of the controller in a wire container.
Figure 2:
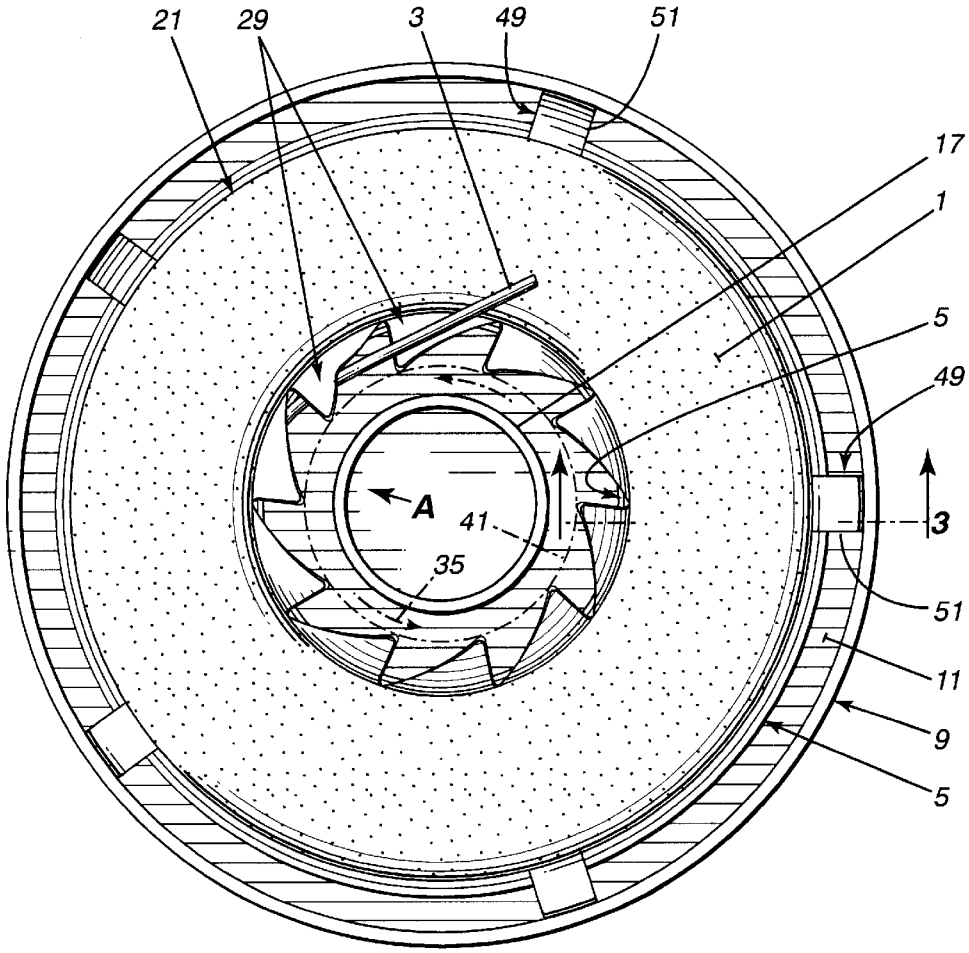
FIG. 2 is a plan view of the controller within the container.

The controller 1 of the present invention, as shown in FIGS. 1 and 2, is used to control the unwinding of a wire 3 from a wire reel 5. The reel 5 is in the from of a tubular cylinder and it sits on one end 7 in a tubular shipping container 9 on the bottom wall 11 of the container. The top 13 of the container 9 is opened when the wire 3 is needed and the wire 3 is pulled out of the open top 13 of the container from the top end 15 of the reel 5, by suitable feeding means (not shown) towards its intended use.

The container 9 can be provided with an inner tubular core 17 if desired. The core 17 would sit within the reel 5 concentric with the container 9. The core 17 is located inwardly of the inner surface of the reel 5 and serves to prevent the wire being unwound off the reel from extending diametrically across the reel which could lead to tangling of the wire. While the container 9 has been shown with a core 17, the core is not essential to proper unwinding using the controller of the present invention.

Figure 3:
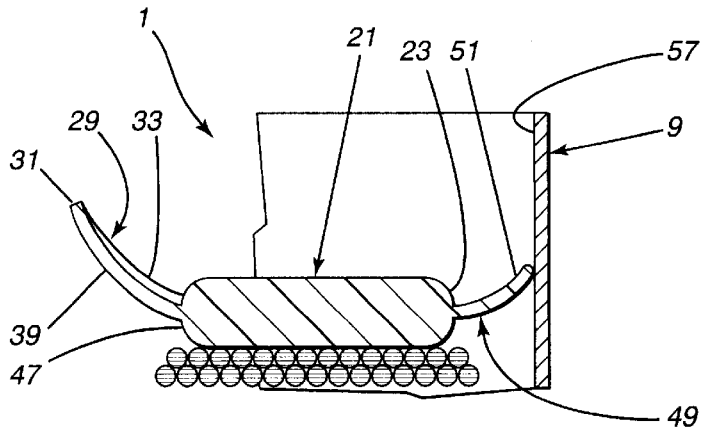
FIG. 3 is a cross-section view taken along line 3—3 in FIG. 2.
Figure 4:
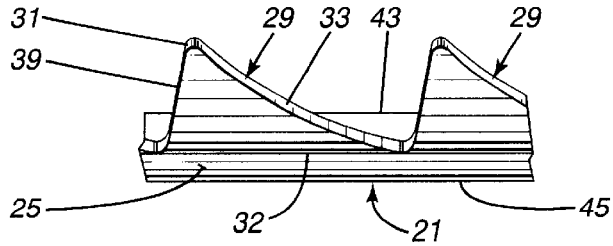
FIG. 4 is a detail side elevation view looking in the direction of arrow A in FIG. 2.

The controller 1, as shown in FIGS. 2 to 4, has a main body member in the shape of a flat, circular, ring 21. The ring 21 is rigid and has concentric, circular, inner and outer edges 21, 23. The diameter D1 of the outer edge 23 of the ring 21 is slightly less than the outer diameter D2 of the reel 5. The diameter D3 of the inner edge 25 of the ring 21 is slightly greater than the inner diameter D4 of the reel 5.

The controller 1 includes a plurality of flexible, thin, wire guide flaps 29 extending inwardly from the inner edge 25 of the ring 21. Each guide flap 29 has the shape of a shallow triangle with the apex 31 of the triangle farthest from the ring 21 and with the base 32 of the triangle adjacent and integral with the inner edge 25 of the ring. Each guide flap 29 has a relatively long side 33, forming a wire guide, which side extends gradually inwardly from the inner edge 25 of the ring 21 toward the center of the ring. The long side 33 is preferably curved slightly outwardly, as shown in FIG. 2, and extends from the inner edge 25 of the ring 21 in the same direction as the direction in which the wire is being unwound as shown by the arrow 35 in FIG. 2. The long side 33 of the flap 29 terminates at the apex 31 of the flap which apex is slightly rounded to form a wire release point. A relatively short side 39 of the flaps 29 connects the apex 31 to the inner edge 25 of the ring. The long side 33 of the flap extends in a direction that is much closer to a tangential direction than a radial direction, relative to the center of the ring, from the inner edge 25 of the ring 21 while the short side 39 extends in a direction that is much closer to a radial direction than a tangential direction from the inner edge 25. Preferably, the short side 39 is nearly radial to the inner edge 25. The long side 33 of the flap is about three times the length of the short side 39.

The guide flaps 29 are equally spaced about the ring 21 and can range in number from between six, when controlling a heavier wire, and twelve, when controlling a lighter wire. Ten flaps are shown. The flaps are arranged serially, one adjacent the next. Preferably, each flap 29 is also formed to gently curve upwardly from the inner edge 25 of the ring 21 to the apex 31, as shown in FIGS. 3 and 4, so that the wire release point is the highest point on each flap. The inner diameter D5 of the controller, defined by an imaginary circular line 41 joining the apexes 31 of the flaps 29, is less than the inner diameter D5 of the reel thereby making it more difficult for any of the top coils of the wire to be pulled off the reel which could lead to snarling.

The guide flaps 29 preferably extend inwardly from the inner edge 25 of the ring from about midway between the top and bottom surfaces 43, 45 of the ring. The bottom inner corner 47 of the ring is preferably rounded up to the flaps 29 to provide a smooth transition for the wire from the reel to the flaps.

The ring 21 preferably includes centering means 49 on its outer edge 23 for generally centering the ring 21 within the container during use. The centering means 49 can comprise flexible, relatively thin, rectangular, tabs 51 that extend radially outwardly from the outer edge 23 of the ring, the tabs 51 equally spaced apart about the ring. The tabs 51 also preferably extend from the outer edge 23 about midway between the top and bottom surfaces 43, 45 of the ring 21.

The controller 1 is molded in one piece. The material employed in the controller is preferably a mixture of plastic and rubber in the ratio of about 70% rubber and 30% plastic. The amount of rubber can range however between 90% and 50% with the remainder plastic. In some instances the controller can be 100% rubber. A mix of plastic and rubber is preferred. The use of rubber provides more flexibility for the flaps 29 and tabs 51. The more flexible the flaps the less tension imparted to the wire as it travels over the flaps during unwinding. Also, more flexible tabs allow the ring to more easily slid down within the container as the wire is unwound. More rubber in the mix also increases the weight of the controller which is desirable to ensure that it is not pulled up by the wire feeding out of the container. The plastic employed can be a polypropylene or a polyethylene. The rubber employed can be most synthetic or natural rubbers, particularly recycled rubbers. A suitable rubber employed is sold under the tradename 'Everflex'.

The controller is normally used with a container without the core. However, if used with a core 17, the controller 1 is formed so that its innermost diameter D5, defined by the imaginary line 41 joining the release points 31 of the flaps 29 is greater than the outer diameter D6 of the core 17 so that the controller 1 does not contact the core. This arrangement reduces friction between the controller and the container making it easier for the controller to slide down within the container and to maintain contact with the top of the reel.

In use, the controller 1 is placed on the top of a reel 5 located within a container 9 as shown in FIG. 1. The controller 1 is centered within the container 9 by the tabs 51, the tabs bent slightly upwardly on the inner wall 57 of the container. The wire 3 is fed from the reel 5 through the inside of the controller and out the top 13 of the container 9. As the wire 5 is pulled out of the container off the top of the reel, it rides up the long guide side 33 of a flap 29 to the apex 31 of the flap, the flexible flap moving upwardly from the tension of the wire. The upward movement of the flap is slight initially, because the flap is not wide initially. However the upward movement gradually increases as the wire nears the apex 31 and the flap becomes wider and thus more flexible. The increasing give of the flap 29 as the wire nears the apex 31 minimizes increase in the tension of the wire as it passes over the flap. As the wire passes over the apex or release point 31 it drops back down toward the start of the guide side 33 on the next adjacent flap 29. The flexible, relatively shallow, flaps 29 ensure that the wire is pulled off the reel more evenly thereby minimizing the chance of wire loops being pulled off and becoming tangled. The controller moves downwardly under its own weight. The downward movement is relatively easy since the ring does not normally contact any center core and in fact no center core is needed. Further, the centering tabs 51, being quite flexible because of the material used, do not unduly hinder the downward movement of the ring.

We claim:

1. A controller for controlling the dispensing of wire from a reel of wire positioned within a container, the wire dispensed from one end of the reel with the other end of the reel sitting on the bottom of the container, the controller having: a main body member in the shape of a flat ring sized to rest within the container on the one end of the reel; the ring having concentric, circular, inner and outer edges; flexible, wire guide flaps on the inner edge of the ring, the guide flaps extending radially inwardly; each guide flap having the general shape of a shallow triangle with the apex of the triangle farthest from the ring and the base of the triangle adjacent and integral with the ring.

2. A controller as claimed in claim 1 wherein each flap has: a relatively long side forming a wire guide, the long side extending gradually inwardly from the base of the triangle at inner edge of the ring to the apex of the flap and extending from the ring in the direction that the wire is being unwound from the reel; and a relatively short side extending from the apex back to the base at the inner edge of the ring.

3. A controller as claimed in claim 2 wherein the long side of the flap curves gradually toward the center of the ring from the inner edge of the ring.

4. A controller as claimed in claim 3 wherein the short side extends in a direction close to a radial direction from the ring.

5. A controller as claimed in claim 4 wherein each flap is curved upwardly from the inner edge of the ring toward its apex.

6. A controller as claimed in claim 5 including centering means on the outer edge of the ring for generally centering the ring within the container.

7. A controller as claimed in claim 6 wherein the centering means comprise flexible tabs spaced about the outer edge of the ring and extending radially outwardly.

8. A controller as claimed in claim 4 wherein each flap extends radially inwardly from the approximate center of the inner edge of the ring and wherein the bottom inner edge of the ring is rounded up toward the flaps.

9. A controller as claimed in claim 2 wherein the short side of the flap extends in a direction close to a radial direction from the ring.

10. A controller as claimed in claim 2 wherein each flap is curved upwardly from the inner edge of the ring toward its apex.

11. A controller as claimed in claim 2 wherein each flap extends radially inwardly from the approximate center of the inner edge of the ring and wherein the bottom inner edge of the ring is rounded up toward the flaps.

12. A controller as claimed in claim 2 including centering means on the outer edge of the ring for generally centering the ring within the container.

13. A controller as claimed in claim 12 wherein the centering means comprise flexible tabs spaced about the outer edge of the ring and extending radially outwardly.

14. A controller as claimed in claim 2 wherein the innermost diameter of the controller, defined by an imaginary circle joining the apexes of the flaps, is greater than the outer diameter of any tubular core member used within the container and is less than the inner diameter of the reel.

15. A controller as claimed in claim 2 wherein the controller is molded in one piece from a mixture of plastic and rubber, the plastic in the mixture ranging from 50% to 90% with the remainder rubber.

16. A controller as claimed in claim 1 wherein each flap is curved upwardly from the inner edge of the ring toward its apex.

17. A controller as claimed in claim 1 wherein each flap extends radially inwardly from the approximate center of the inner edge of the ring and wherein the bottom inner edge of the ring is rounded up toward the flaps.

18. A controller as claimed in claim 1 including centering means on the outer edge of the ring for generally centering the ring within the container.

19. A controller as claimed in claim 1 wherein the innermost diameter of the controller, defined by an imaginary circle joining the apexes of the flaps, is greater than the outer diameter of any tubular core member used within the container and is less than the inner diameter of the reel.

20. A controller as claimed in claim 1 wherein the controller is molded in one piece from a mixture of plastic and rubber, the plastic in the mixture ranging from 50% to 90% with the remainder rubber.

* * * * *